United States Patent [19]

Corompt

[11] 3,962,965

[45] June 15, 1976

[54] PLANT FOR THE COMPRESSION OF GARBAGE

[75] Inventor: Antoine Corompt, Saint-Etienne, France

[73] Assignee: Bennes Marrel, Saint-Etienne, France

[22] Filed: July 18, 1972

[21] Appl. No.: 272,839

[52] U.S. Cl. ..... 100/99; 100/215; 100/218; 100/229 A; 214/41 A

[51] Int. Cl.[2] ..... B30B 15/30

[58] Field of Search ..... 214/41; 100/99, 35, 100/193, 229 A, 215, 218; 37/115

[56] References Cited

UNITED STATES PATENTS

| | | | |
|---|---|---|---|
| 3,013,675 | 12/1961 | Schonrock | 214/41 |
| 3,059,789 | 10/1962 | Bowles | 214/41 |
| 3,135,400 | 6/1964 | Tapp et al. | 100/229 A |
| 3,393,652 | 7/1968 | Connell | 214/41 X |
| 3,417,883 | 12/1968 | Felts | 214/41 |
| 3,541,710 | 11/1970 | Sankey et al. | 37/115 |
| 3,561,624 | 2/1971 | Thurmond | 214/41 |
| 3,640,411 | 2/1972 | Anderson | 214/41 |
| 3,686,889 | 8/1972 | Harza | 100/229 A |
| 3,691,943 | 9/1972 | Boyd | 100/215 |
| 3,753,506 | 8/1973 | Palmer et al. | 214/41 X |
| 3,878,774 | 4/1975 | Frossard | 100/215 X |

FOREIGN PATENTS OR APPLICATIONS

| | | | |
|---|---|---|---|
| 393,164 | 10/1965 | Switzerland | 100/215 |

*Primary Examiner*—Billy J. Wilhite
*Attorney, Agent, or Firm*—Browdy and Neimark

[57] ABSTRACT

A plant for the compression of garbage which includes at least one compactor having a horizontal pusher device disposed under a hopper to force the garbage into a container. The hopper is placed at the end of a large capacity storage pit into which the loose garbage is dumped and means are provided for transferring the garbage into the hopper of the compactor.

14 Claims, 14 Drawing Figures

PLANT FOR THE COMPRESSION OF GARBAGE

The present invention concerns the layout of a plant for the compression of garbage, and in particular of domestic garbage.

Plants of the above type are known, which include transverse trenches into which the garbage is unloaded to fall then into a pit from which a compacting pusher device forces it into a container. The containers are placed ready on a loading area where, when full, they are loaded onto lorries which carry them away to disposal fields or incinerating plants.

The present invention relates to improvements in such a plant, with a view to increasing its production capacity and improving its versatility of operation.

A refuse compressing plant according to the invention is of the above-mentioned type, and is characterized in that it includes at least one compactor having a horizontal pusher device and disposed under a hopper to force the refuse into a container, said hopper being placed at the end of at least one large capacity storage trench into which the loose refuse is tipped out, while a dragline operated from a distance by a cable mechanism is provided to move along its bucket over the refuse in order to bring the latter into the hopper of the compactor. Thanks to this arrangement, it is possible to use a very long trench, on either side of which the collecting lorries arrive and discharge their contents transversely, while the bucket of the dragline ensures the service of the trench, the piling of the refuse, and the conveying thereof towards the compacting hopper.

According to another feature of the invention, at least one of the side walls of the hopper is provided with a release shutter adapted to swing about a horizontal axis from which it is hung, while means are provided to control the swinging of said shutter in either direction. Said means consist preferably of at least one double acting hydraulic jack. Besides, a sheet iron scraper with an arcuate profile is disposed under the movable lower edge of the shutter to prevent the refuse from escaping.

An advantageous feature of the invention consists in placing the trench, the dragline, the hopper, and the compactor in one and the same building in the form of a bay provided along its two longitudinal walls with lift up doors, each of which can open to allow a lorry coming to tip its contents into the trench to unload. This makes it possible to dispose several such bays side by side, while free areas are reserved between the bays to allow the traffic of the collecting lorries which come and unload in front of the unloading doors. Moreover, if a two-way track is provided along the first bay for the arrival and departure of the collecting lorries, the whole side of the last bay remains free, so that, later on, it is possible to build beyond the latter any number of additional bays, and increase gradually the production capacity of the compacting plant as it expands.

As regards the supply of containers on the departure area, it is preferred to use containers conforming to ISO international standards, the handling of which is ensured by at least one grab frame or spreader frame suspended from an overhead crane moving transversely opposite the outlets of the compactors. To make the handling easier, a container carrier is provided in front of each said outlet, which carrier is at least longitudinally movable, so that such container can be applied against a compactor in order to be filled, and then carried away to enable the spreader frame to grip it.

The appended drawing, which is given by way of a non-limiting example, will enable the features of the invention to be better understood. In said drawing.

Figure 1:
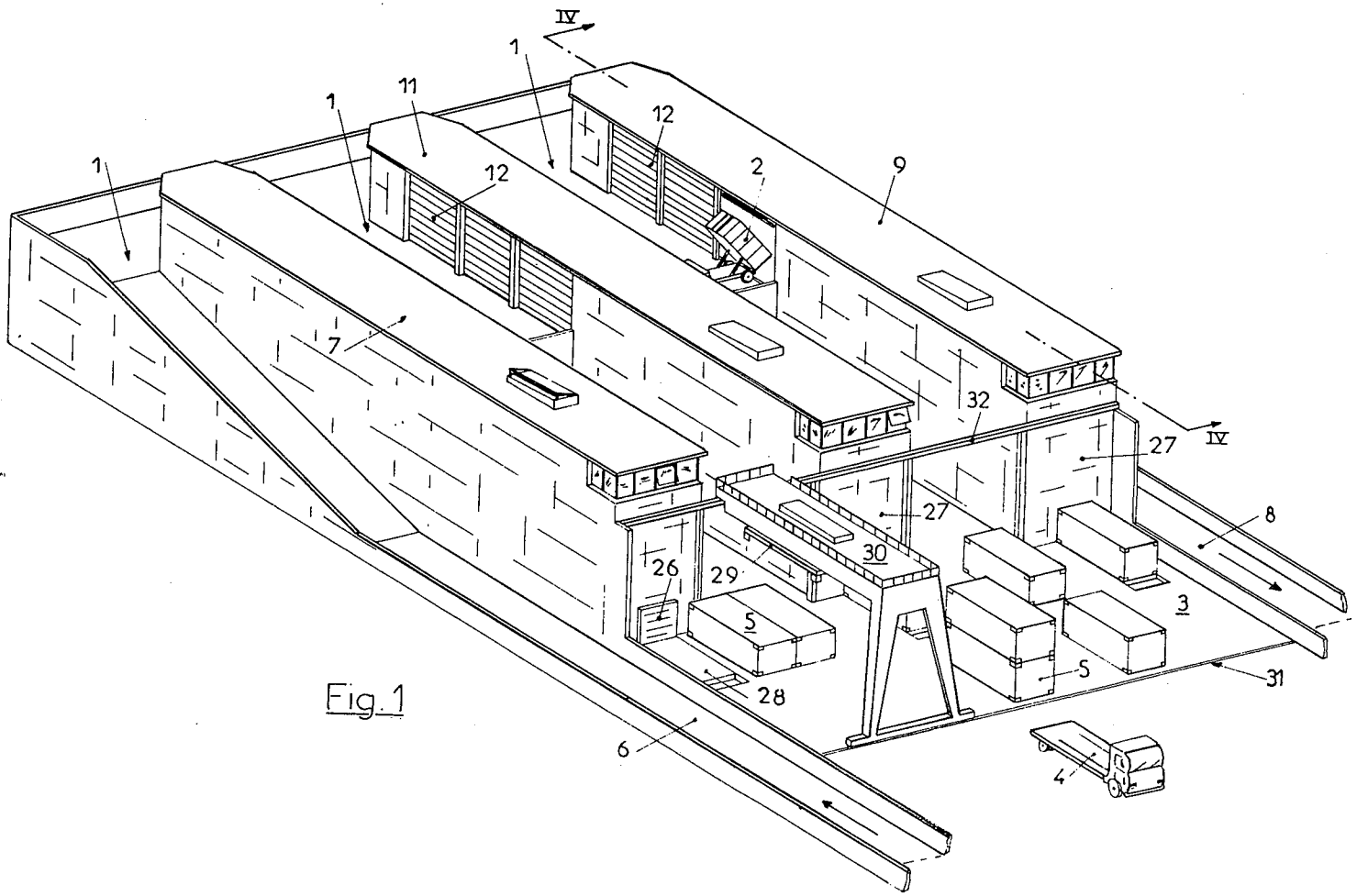
FIG. 1 is a general view of the whole refuse compacting plant according to the invention.

The plant illustrated in the drawing includes two floors on which lorries can run, to wit:

an upper floor constituted by flat areas 1, and on which the lorries 2 carrying household refuse can move when coming to unload their contents;

a lower floor including an area 3 on which lorries 4 or tractors can move to take the containers 5 filled with compacted refuse, so as to carry them away from the plant or to disposal fields.

Figure 2:
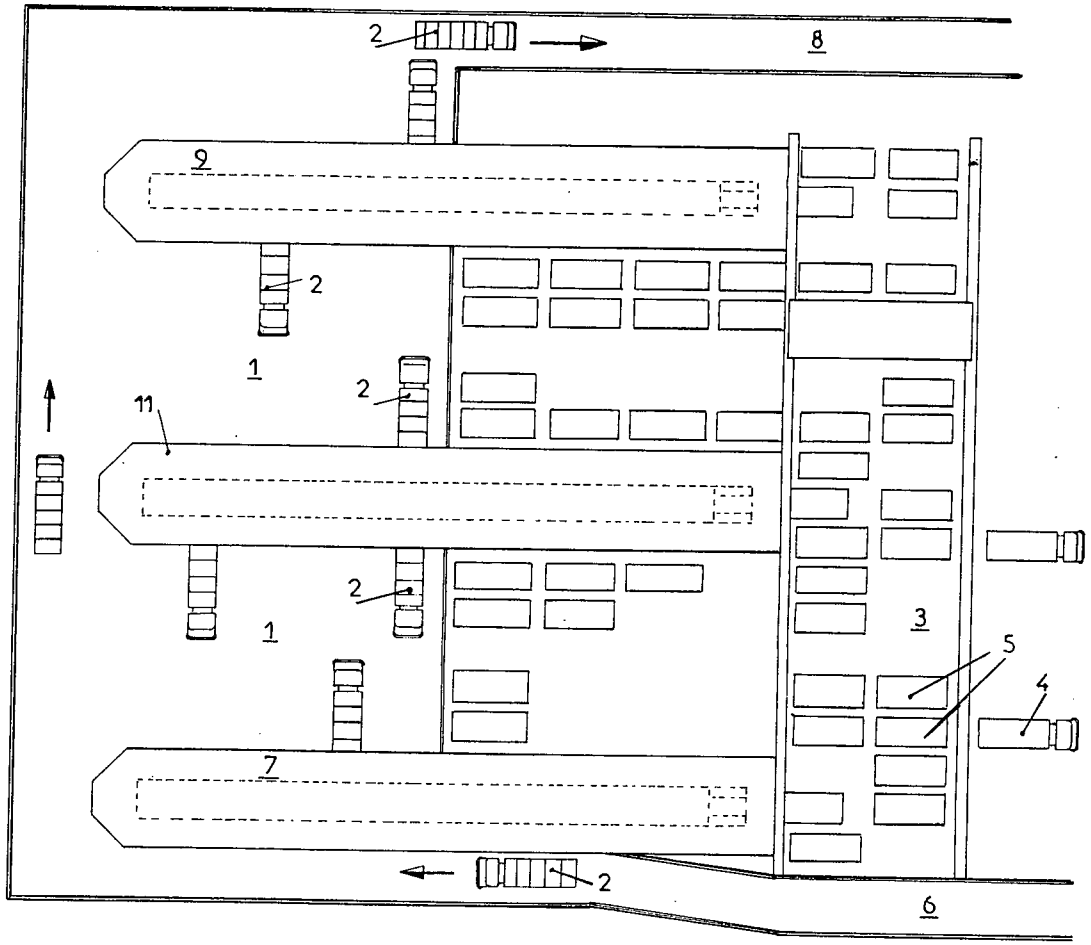
FIG. 2 is a plan view thereof.

In the case of FIGS. 1 and 2, the collecting lorries 2 enter the plant by means of an arrival slope 6 located along a first bay 7 of the building, while the exit is provided by a return slope 8 located behind the last bay 9.

Figure 3:
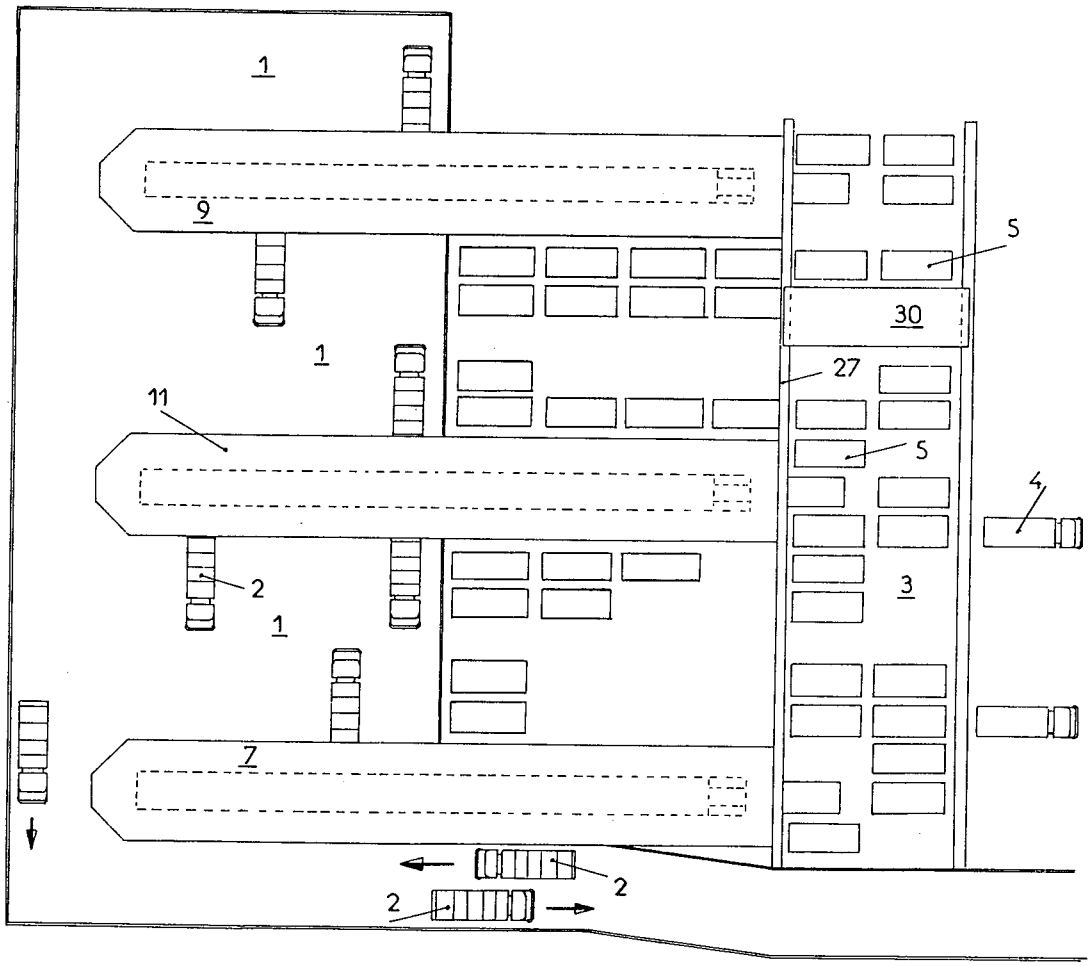
FIG. 3 is a plan view of a modification, with a single two-way slope for the collecting lorries.

On the contrary, in the case of FIG. 3 the arrival and the departure of the collecting lorries 2 take place on the same slope 10, which is a two-way slope located along the first bay 7. Thus, should it be wanted to enlarge the plant by building additional bays beyond the last bay 9, it would be possible to do so without any preliminary work such, for instance, as displacing the departure slope 8 as would be the case with the arrangements of FIGS. 1 and 2.

In all cases, any number of intermediate bays such as 11 can be interposed between the end bays 7 and 9.

Each bay 7, 9, or 11, has the structure shown in FIGS. 4 to 8. In particular, the bay is in the shape of an elongated building, in the side walls of which doors 12 are provided, each said door being remotely controlled from a control cabin 13. The latter is located within the bay, the whole of which is thus watched by a single operator.

Figure 4:
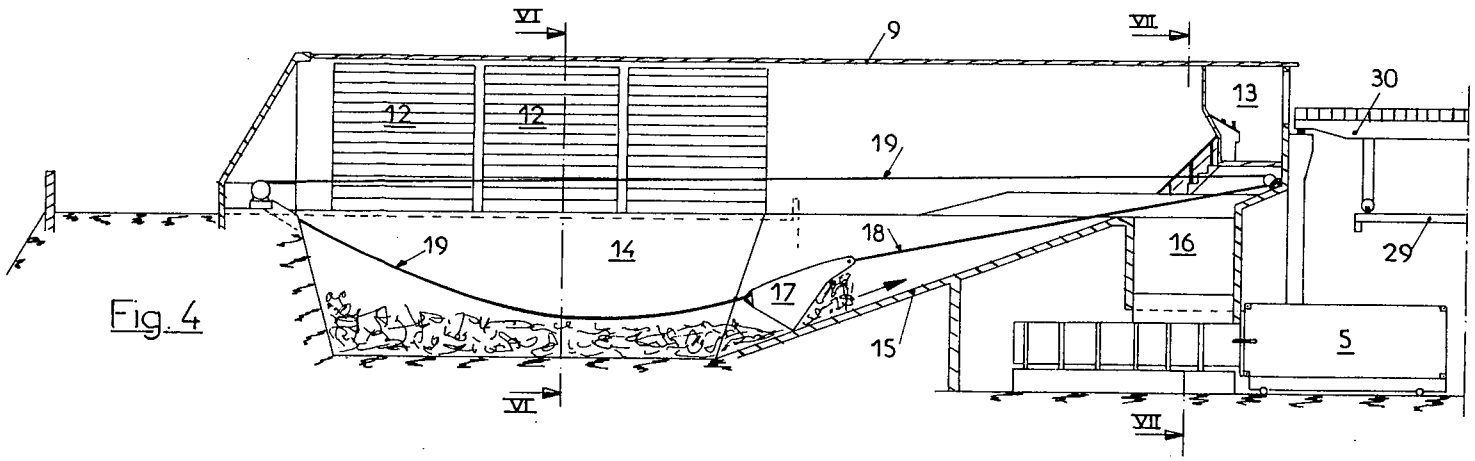
FIGS. 4 and 5 are longitudinal sections along the line IV—IV in FIG. 1, showing the arrangement of the dragline in each trench.
Figure 5:
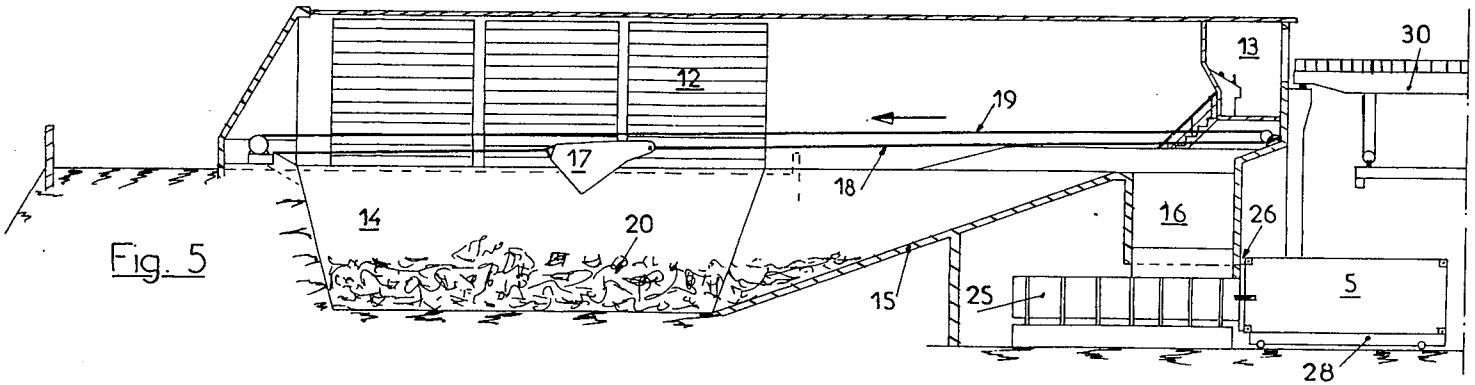
Figure 6:
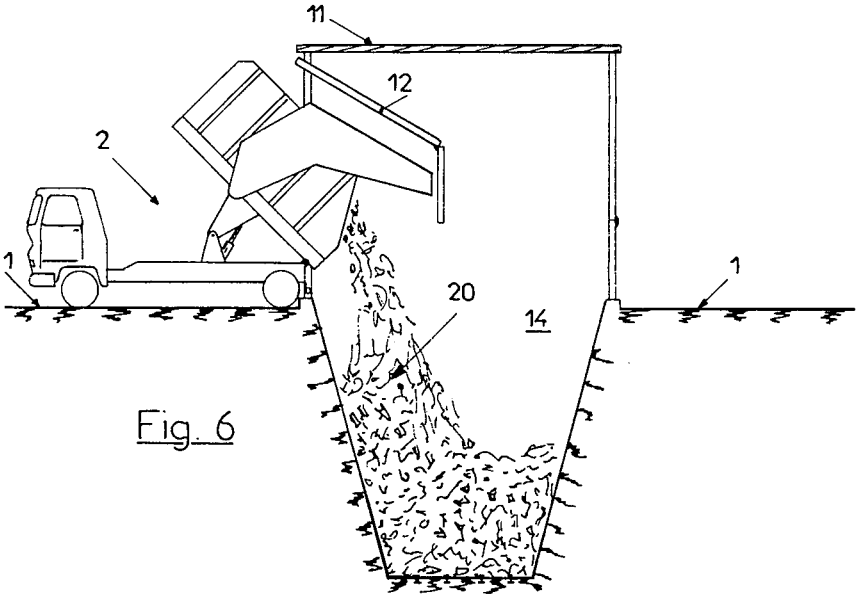
FIG. 6 is a cross-section along the line VI—VI of FIG. 4.
Figure 7:
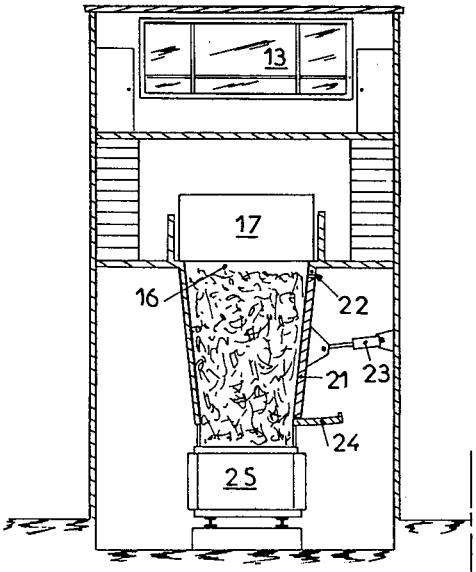
FIGS. 7 and 8 are sections along the line VII—VII of FIG. 4, and illustrate the release shutter of the hopper.
Figure 8:
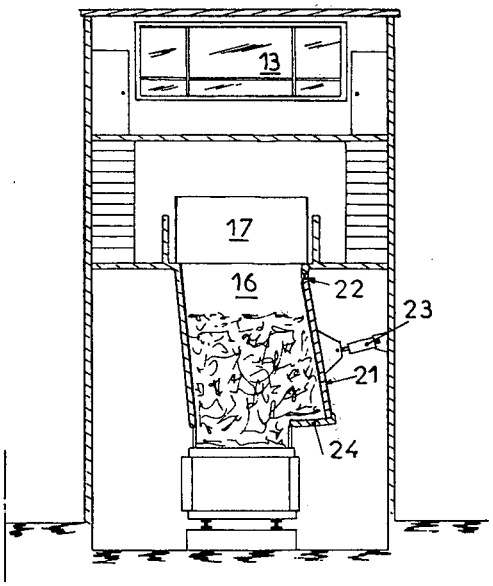

The base of the bay is constituted by a deep, very long trench 14, the walls of which converge towards the bottom thereof (FIGS. 4 to 6). At one end, the bottom of the trench 14 rises in a gentle slope 15 to open out on the top of a hopper 16. A dragline comprising a bucket 17 and cables 18 and 19 is controlled from the control cabin 13 to ensure the service in the trench 14, that is, to distribute and pile up the refuse 20 therein, or to carry said refuse along to the compacting hopper 16.

By virtue of this arrangement, it is possible to build bays and trenches 14 of very great length and, therefore, of very great capacity. In the drawing, only three doors 12 have been shown on either side of the trench 14, but obviously the number of such doors could be much greater. Thus, a large nunber of collecting lorries can come and unload simultaneously, which is advantageous to the plant as a whole, especially during peak hours.

Each hopper 16 has at least one lateral release shutter constituted by a shutter 21 suspended from a horizontal shaft 22 to swing thereabout. The swinging shutter 21 is controlled by at least one double acting hydraulic jack 23, while a fixed iron sheet or scraper 24 with an arched profile is provided under the movable lower edge of the shutter 21. This shutter prevents the hopper 16 from being choked up by the refuse 20 being tight packed therein.

The lower part of the hopper 16 opens over a compactor 25 provided with a horizontal pusher device. The pusher device forces the refuse 20 through the outlet 26 of the compactor, so that the refuse enters a container 5. The latter is carried by a carrier 28 adapted to move to and fro, which allows bringing the containers 5 near to the outlet 26 of the compactor to be locked there, and then, after their loading, to be moved away from the wall 27. Each container 5 lying on the area 3 is handled by the spreader frame 29 of at least one overhead crane 30. The latter can move along two tracks 31 and 32 disposed one on the ground, the other at the top of the wall 27, or else on two tracks disposed on the same level.

The operation can be understood from the above description, that is to say, the collecting lorries 2 which run on the upper areas 1 reverse up against the sides of the bays 7, 9, 11, to tip their loads into the trenches 14. In each trench 14 the dragline 17-18-19 ensures the feeding of the hopper 16 which supplies the compactor 25. The latter forces the refuse into an ISO container 5, latched onto the outlet 26. The compacting of the refuse thus takes place directly inside the containers, without any actual previous compressing. Then, the overhead crane 30 handles the containers 5 waiting on the area 3, and can even stack them, as shown in FIG. 1. The removal to the disposal fields is ensured by the lorries 4 manoeuvring on the lower area 3.

Figure 9:
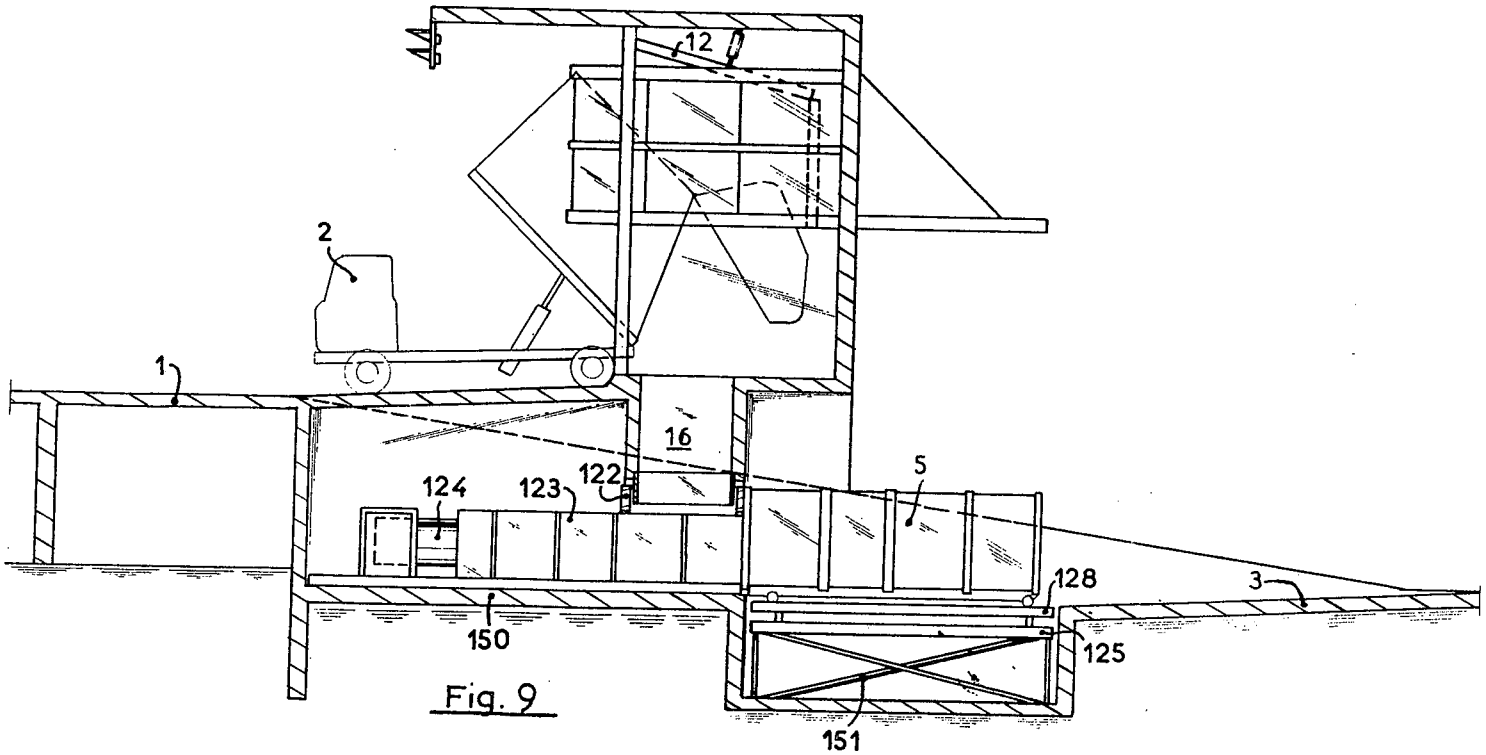
FIG. 9 is a longitudinal section of a compactor unit.

It will be seen from FIG. 9 that the lower part of each hopper 16 ends in a fixed skirt surrounded by the wall 122 of the compacting chamber, into which a compacting pusher device 123 is able to enter under the action of a jack 124. The compacting chamber 122, the pusher device 123, and the jack 124 are carried by a stationary base 150, in the prolongation of which is the movable scale 125 of a weighing machine 151. The latter is preferably an electronic machine, since, as is known, such a machine enables heavy loads to be accurately weighed with only a play of a few millimetres for the scale or plate 125.

Figure 10:
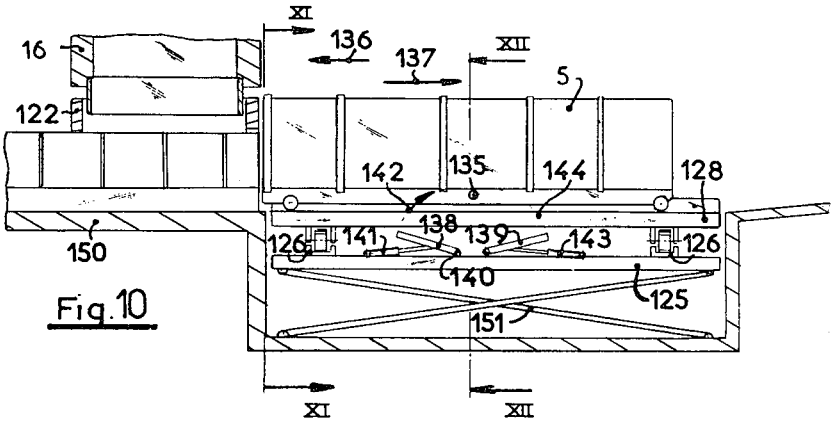
FIG. 10 shows a detail of FIG. 9 at an enlarged scale.
Figure 11:
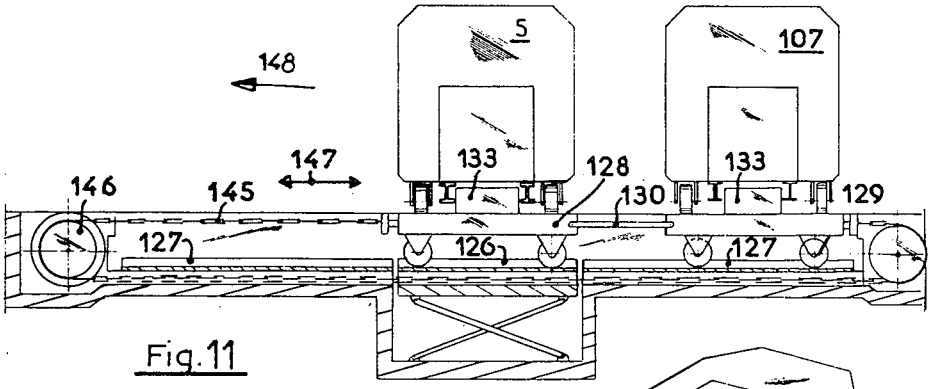
FIG. 11 is a section along line XI—XI of FIG. 10.

On the other hand, the plate 125 carries two transverse rails 126 (FIGS. 10 and 11) which are located in the prolongation of rails fixedly mounted on either side in the concrete mass, and indicated by 127. Two identical carriers 128, 129, mounted side by side and interconnected by knuckle-jointed connecting rods 130, are adapted to run on the rails 126 and 127. Each carrier 128 or 129 carries longitudinal roller tracks 131 adapted to receive the carrying wheels 132 of a container 5 or 107 of a known type. On the other hand, a longitudinal platform 133 with an oblique entrance (FIG. 12) projects from the centre of the carrier 128 or 129. The two I bars 134 which constitute in the usual way the sills of a container are received on either side of the platform 133, while the wheels 132 run on the tracks 131.

Figure 12:
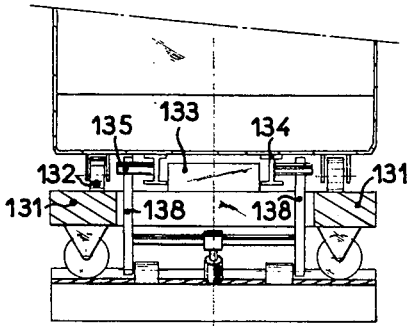
FIG. 12 is a section along line XII—XII of FIG. 10.
Figure 13:
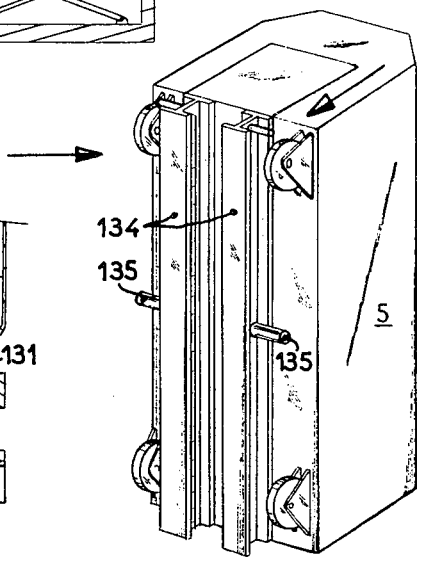
FIG. 13 shows a detail of the means for latching a container onto the compactor unit.

On the other hand, short crosspieces 135, which are outwardly directed, are welded to the I bars 134, on the sides thereof (FIGS. 12 and 13). Said crosspieces 135 are used as points of support for moving the container 5 forwards (arrow 136, FIG. 10) or backwards (arrow 137, FIG. 10) over a short distance with respect to its carrier 128, in order to fit said container to the latching system provided at the entrance of the compacting chamber or, on the contrary, release said container therefrom. Said motions, the magnitude of which is of the order of 20 centimetres, are obtained by means of two swinging arms 138, 139, mounted on the plate 125 of the weighing machine, underneath the carrier 128. The arm 138 swings round a transverse lower pin 140 under the action of a drive jack 141. The arm 138 is in the shape of a fork, the bars of which come to fit on either side of the sills 134, through the structure of the carrier, so as to bear against the crosspieces 135 (FIG. 12). It will be seen that, if the jack 141 is extended, the arm 138 rocks in the direction indicated by arrow 142 in FIG. 10, till it engages the sills 135 to cause the container 5 to move back in the direction of arrow 137.

On the contrary, if the jack 143, which is symmetrically disposed to actuate the forked arm 139, is extended, the arm 139 rises (arrow 144) till it bears likewise against the sills 135 to push the container in the direction of arrow 136, whereby the container is applied against the latching system of the compacting chamber integral with the loading skirt 122.

The two carriers 128 and 129, which are disposed side by side near each loading hopper 16, are interconnected by an endless chain 145 (FIG. 11) adapted to be driven in either direction (double arrow 147) by a reversing motor 146. Thus, it is possible to bring now the carrier 128 with its container 5, now the carrier 129 and another identical container 107, onto the scale 125 of the weighing machine 151. As soon as a container such as 5 is full, it is removed by shifting its carrier 128 sidewise (FIG. 11, arrow 148), whereby the empty container 107 is immediately brought to a loading position in front of the hopper 16. During the filling of the container 107, there is plenty of time for removing the full container 5 towards the area of the lower floor 3 of the plant (FIGS. 1 and 9) and replace it by another empty container. Then, when the container 107 is in turn full, it is removed sidewise by shifting the carriers in a reverse direction to the arrow 148, and the cycle may start again. Finally, there is always an empty container waiting near the container being filled.

It will be seen that a plant according to the invention allows loading the containers to the maximum permitted by the requirements of the traffic regulations, whereby the equipments operate at the full capacity thereof.

Figure 14:
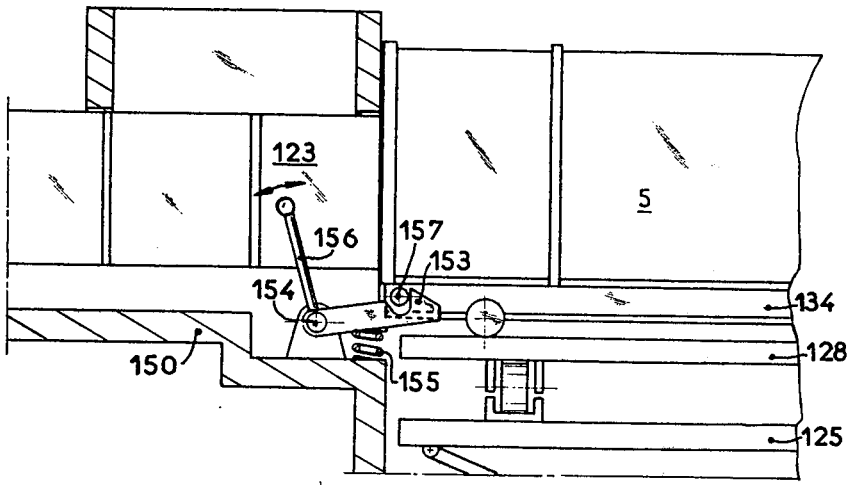
FIG. 14 is a side view of a container locked in position for compacting refuse.

FIG. 14 shows in a detailed way the latching system for connecting containers 5 to the compactor, without hindering the weighing operations. Two crosspiece sections 157 are welded on either side of the sills 134 at the front part of each container 5 or 107 (FIGS. 13 and 14). Each piece 157 comes automatically to lock itself behind the nose of a pedal hook 153 which swings round a fixed pin 154. The lowering of the hooks 153 takes place against the action of return springs 155 when the container 5 is brought before the pusher device 123 of the compactor. A lever 156 integral with each hook 153 allows lowering the latter by hand and releasing the container 5 when full. It will be seen that this arrangement ensures a firm latching without hindering the small vertical play of the scale 125 of the weighing machine.

Of course, besides, the dragline 17–18 could be replaced by an overhead grapple travelling over the garbage pit 14.

I claim:

1. A non-transportable plant for the compaction of garbage or refuse and its removal in containers, comprising:

a large capacity storage pit for the unloading of refuse;

compactor means placed at the end of said storage pit for the compaction of garbage or refuse into the container;

a hopper disposed above said compactor means;

transferring means in said storage pit for transferring the garbage from said storage pit to said hopper;

a weighing machine having a scale plate, said scale plate being disposed in front of the outlet of said compactor means so as to align any container employed thereon with said compactor means;

first and second carriers, said first carrier flexibly connected to said second carrier;

longitudinal tracks on each of said carriers for carrying a container thereon;

a transverse track on which said first and second carriers are moveable in a transverse direction, a portion of said transverse track being located upon said scale plate;

alternating translation means for causing said carriers to travel on said transverse track in order to bring each carrier alternately onto said weighing machine and into alignment with said compactor means.

2. A plant according to claim 1, wherein at least one of the side walls of the hopper is provided with a release shutter adapted to swing about a horizontal axis from which it is hung, while means are provided to control the swinging of said shutter in either direction.

3. A plant according to claim 2, characterized in that the control means for the release shutter include at least one double acting jack.

4. A plant according to claim 2, characterized in that a sheet iron scraper with an arcuate profile is disposed under the movable lower edge of the shutter.

5. A plant according to claim 1, wherein said transferring means consists of a dragline remotely controlled by a cable mechanism, the bucket of said dragline being dragged inside the pit to move the garbage towards the hopper.

6. A plant according to claim 1 further including several bays disposed side by side and between which free areas are reserved to allow the traffic of the collecting lorries which come and reverse in front of the unloading doors.

7. A plant according to claim 6, characterized in that it includes a two-way track along the first bay for the arrival and departure of the collecting lorries, so that the whole side of the last bay remains free.

8. A plant according to claim 1, wherein the handling of said containers is ensured by at least one grab frame suspended from an overhead crane travelling transversely opposite the outlets of the compactors.

9. A plant according to claim 1, characterized in that the plate of the weighing machine carries two transverse rails located in the prolongation of rails fixedly mounted on either side in the concrete floor, while two identical carriers disposed side by side can run on said transverse rails.

10. A plant according to claim 9, characterized in that two swinging arms are oppositely mounted on the plate of the weighing machine, said arms being each controlled by a jack and adapted to pass through the structure of either one of the carriers to come and bear against crosspiece sections welded to the underframes of the containers on either side of the sills thereof.

11. A plant according to claim 10, characterized in that each swinging arm is in the shape of a fork, the bars of which come to fit on either side of the sills of a container after passing through the structure of the carrier.

12. A plant according to claim 1, characterized in that each carrier is provided at its upper surface with longitudinal roller tracks adapted to receive the wheels of a container of a known type, while a centring platform with an oblique entrance projects from the centre of the carrier.

13. A plant according to claim 1, characterized in that the two carriers disposed side by side are connected by an endless chain which a reversing motor is adapted to drive in either direction.

14. A plant according to claim 1, characterized in that each container is further provided with two crosspiece sections and two sills, said sills affixed to the underside of said container and said crosspiece sections fixed on either side of the sills of the carrier, so as to ensure the removable latching of the latter on the compactor by means of hand-collapsible pedal hooks which are returned by return springs.

* * * * *